United States Patent [19]

Rubens

[11] 4,266,881

[45] May 12, 1981

[54] PEN WITH RETRACTABLE POINT

[75] Inventor: Harry E. Rubens, Bay Harbor Islands, Fla.

[73] Assignee: Institute of Applied Biology Charitable Research Trust, Bay Harbon Islands, Fla.

[21] Appl. No.: 943,009

[22] Filed: Oct. 18, 1978

[51] Int. Cl.[3] ..... B43K 24/02; B43K 27/12

[52] U.S. Cl. ..... 401/32; 401/115; 401/117

[58] Field of Search ..... 401/29, 31, 32, 17, 401/115, 117, 30

[56] References Cited

U.S. PATENT DOCUMENTS

| | | | |
|---|---|---|---|
| 2,435,185 | 1/1948 | Reynolds | 401/117 |
| 3,046,943 | 7/1962 | Rhoades | 401/117 |
| 3,158,138 | 11/1964 | Bross | 401/29 |
| 3,288,116 | 11/1966 | Poritz | 401/30 |
| 3,801,206 | 4/1974 | Poritz | 401/29 |
| 4,000,950 | 1/1977 | Wahlberg | 401/32 |
| 4,136,980 | 1/1979 | Leem | 401/31 |

*Primary Examiner*—William Pieprz

[57] ABSTRACT

The pen consists of two pen bodies, preferably identical, which interlock with each other in a plurality of longitudinal positions. Each of the pen bodies is preferably provided with a seat for positioning a ball point cartridge therein. Movement of the pen bodies will cause the cartridges seated therein to be protracted or retracted.

5 Claims, 4 Drawing Figures

PEN WITH RETRACTABLE POINT

My invention relates to pens with retractable points, and more particularly to retractable pens containing a minimum number of parts. The most popular ball point pens on the market today of a retractable nature, require springs. It is an object of my invention to provide a retractable pen that is springless, thus eliminating a part in the assembly of the pen.

Another object of the invention is to provide such a pen containing a plurality of cartridges each of which can be protracted and retracted.

Further objects are to provide such a pen, in which the dual cartridges can be selectively protracted; to provide a pen consisting of two pen bodies each of which contains a seat for positioning a cartridge thereon; and which pen bodies can be made identically, to reduce the cost of manufacture.

These and other objects are attained and my new results accomplished, as will be apparent from a consideration of the following description and claims, taken together with the accompanying drawing, in which:

Figure 1:
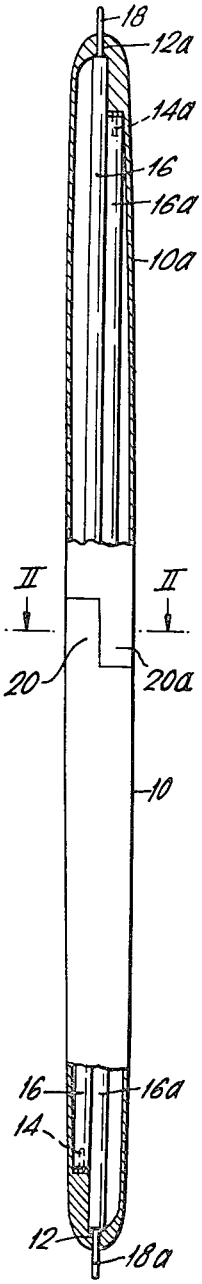
FIG. 1 is a side elevation, partly in section, of my proposed pen.
Figure 2:
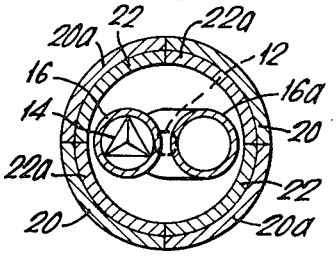
FIG. 2 is a cross-sectional view taken in the plane 11—11 of FIG. 1 and in the direction indicated by the arrows.
Figure 3:
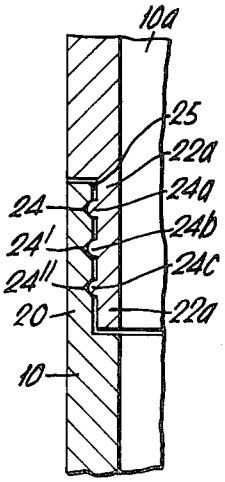
FIG. 3 is a fragmentary longitudinally sectioned view, taken through an interlocking portion of the pen bodies, when the cartridges are moved to protracted position.
Figure 4:
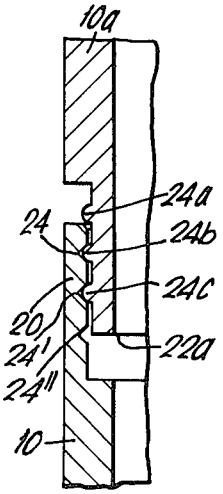
FIG. 4 is a similar view, with one or more cartridges in retracted position.

More specifically, FIG. 1 illustrates pen bodies 10 and 10*a*, each each provided with a cartridge point opening 12 and 12*a*, respectively, and pointed pegs 14 and 14*a*, adjacent the cartridge openings, for seating and securing the tubular cartridges 16 and 16*a*, thereover. The cartridge points 18 and 18*a* are shown extending through the openings 12 and 12*a*, each protracted into writing position.

The pen bodies are each formed with outer lip extensions 20 and 20*a* respectively, which interlock with inner lip extensions 22 and 22*a*, respectively of the other pen body.

The interlock between pen bodies may be accomplished by providing lip extensions 20 and 20*a*, with circumferential grooves, such as 24, 24', and 24'' on outer lip extension 20, and circumferential ridges 24*a*, 24*b*, and 24*c* formed formed on inner lip extensions 22 and 22*a*.

The movement of the pen bodies in opposite directions will cause the ridges to move out of the seated grooves, and into an agjacent groove, thus permitting the interlocked lip extensions to change relative positions, step by step, depending on whether the pen bodies are moved in separating direction or are compressed towards each other. Thus the cartridge points are retracted or protracted, as required.

Only one ridge and two grooves need be employed to give the two position movement of the pen bodies. However extra ridges and grooves may be added to give better axial support of the pen bodies with respect to each other, or to provide a selective exposure of the writing points which may be obtained by having one cartridge with a longer writing point so that it will be exposed in writing position first. Further compression of the two bodies will cause the shorter writing point to appear. This same selective projection will take place if the cartridges are of the same size, but the cartridge of the first projected pen point to appear, is seated nearer the center of the pen by a distance equal to the distance between adjacent grooves nn the lip extension 20.

One of the cartridges may be colored differently than the other, to provide alternative shades.

The cartridges are slightly tilted to center the openings. The openings themselves may be slightly off-center to keep the cartridges in longitudinal alignment.

The slight flexing of the inner and outer lip extensions can be obtained from most plastics. The flexing can be enhanced by making the walls thinner; by using a longer lip extension; or by forming longitudinal slits in the lip extension to reduce the circumferential width of each lip.

The two pen bodies may be identically made from the same mold, thus reducing the cost of manufacture.

More than two cartridges may be positioned in the pen, but of course, only one or two may be projected through the pen apertures. Thus a wide variety of colored ink cartridges may provided, requiring a change of cartridge positions, if more than two are needed. The seats for the stored cartridges should be positioned nearer the pen body opening to completely contain them in the pen throughout the movement of the pen bodies with respect to each other.

The pen bodies will operate with only a single cartridge seat, and only a single cartridge point opening.

The distance between grooves and their respective ridges, determines the movement of the cartridges. The distance is sufficient to protract a cartridge or retract the same. To facilitate assembly of the pen body halves, the lip extensions should be rounded as at 25, and the ridges and grooves should be tapered or rounded to facilitate entry and exit of the ridges with respect to the grooves.

In the construction of the pen illustrated and described, I have achieved the objects of the invention, and my new results, by providing a pen without springs, and with a minimum number of parts for a retractable cartridge pen. Without increasing the number of parts, a plurality of cartridges may be protracted, and retracted. By making the pen bodies identical, further economy in manufacture can be obtained. It is further noted that other modifications are possible without departing from the inventive concept and that the invention is not limited to the particular for shown and described.

What I claim is:

1. A pen for use with an ink cartridge, comprising two pen bodies each having at one end thereof, integrally formed, longitudinally extending, resilient portions, interlockable to each other, for enclosing the cartrige, having an opening in at least one said body at a second end thereof for allowing the point of the cartridge to be projected therethrough in writing position; a seat in at least one said pen body for positioning the cartridge thereon; said pen bodies resiliently interlocked to each other, in not less than two positions, one for moving the cartridge into protract position when the two bodies are moved towards each other manually, and the other position for manually retracting the cartridge when the cartridge when the two bodies are pulled away from each other; the longitudinally extending portions of one body being identical to the longitudinally extending portions of the other body.

2. The pen of claim 1, consisting only of two pen bodies and cartridges therefore, said pen bodies provided with integrally formed seats for the cartridges, each of the pen bodies being identical with the other pen body, to permit each of the pen bodies to be made from the same mold.

3. The pen of claim 1 in which the two bodies are identical.

4. The pen of claim 1 in which each of the pen bodies is provided with an integrally formed cartridge seat.

5. The pen of claim 1 in which the extending portions comprise outer and inner lip extensions having grooves and ridges which interlock with each other.

* * * * *